US011779063B2

(12) United States Patent
Burgoyne et al.

(10) Patent No.: US 11,779,063 B2
(45) Date of Patent: Oct. 10, 2023

(54) GARMENT

(71) Applicant: Greenburg UK Limited, Knaresborough (GB)

(72) Inventors: Myles Cowburn Burgoyne, York (GB); Christopher Maidment Green, Knaresborough (GB)

(73) Assignee: GREENBURG UK LIMITED, Knaresborough (GB)

( * ) Notice: Subject to any disclaimer, the term of this patent is extended or adjusted under 35 U.S.C. 154(b) by 474 days.

(21) Appl. No.: 16/605,664

(22) PCT Filed: Apr. 9, 2018

(86) PCT No.: PCT/GB2018/050938
§ 371 (c)(1),
(2) Date: Oct. 16, 2019

(87) PCT Pub. No.: WO2018/193225
PCT Pub. Date: Oct. 25, 2018

(65) Prior Publication Data

US 2020/0037679 A1 Feb. 6, 2020

(30) Foreign Application Priority Data

Apr. 20, 2017 (GB) ..... 1705748

(51) Int. Cl.
*A41D 13/00* (2006.01)
*A61G 7/10* (2006.01)
*A41D 13/12* (2006.01)

(52) U.S. Cl.
CPC ..... *A41D 13/0007* (2013.01); *A61G 7/1051* (2013.01); *A41D 13/1236* (2013.01); *A61G 7/1015* (2013.01)

(58) Field of Classification Search
CPC ..... A41D 13/0007; A41D 13/1236; A41D 13/1245; A41D 13/1254; A61G 7/1051;
(Continued)

(56) References Cited

U.S. PATENT DOCUMENTS 2,719,568 A 10/1955 Webb
4,429,419 A 2/1984 Snyder
(Continued)

FOREIGN PATENT DOCUMENTS

DE 3222225 A1 12/1983
DE 10-2010-012353 A1 6/2011
(Continued)

OTHER PUBLICATIONS

Intellectual Property Office, Great Britain Search Report for Great Britain Patent Application No. GB 1705748.0, dated Jun. 28, 2017, (5 pages), Yorkshire, United Kingdom.
(Continued)

*Primary Examiner* — Justin C Mikowski
*Assistant Examiner* — Luke Hall
(74) *Attorney, Agent, or Firm* — Alston & Bird LLP

(57) ABSTRACT

A garment is provided for moving an incapacitated person. The garment includes a wearable body portion; and a support portion comprising a plurality of attachment elements attachable to a lifting device. Further, the plurality of attachment elements comprises a first attachment element located at a first location on a first side of a sagittal plane of the garment and a second attachment element located at a second location on a second side of the sagittal plane and substantially opposed to the first location. A method of moving an incapacitated person and a system comprising a garment and a sling are also provided.

12 Claims, 7 Drawing Sheets

(58) Field of Classification Search
CPC ..... A61G 7/1015; A62B 35/0012; A62B 35/0018
USPC ..... 5/81.1 R
See application file for complete search history.

(56) References Cited

U.S. PATENT DOCUMENTS

| | | | | |
|---|---|---|---|---|
| 4,748,701 | A * | 6/1988 | Marlowe | A61G 7/1061 5/89.1 |
| 5,514,019 | A | 5/1996 | Smith | |
| 6,122,778 | A | 9/2000 | Cohen | |
| 2003/0172431 | A1* | 9/2003 | Allen | A41D 13/0007 2/69 |
| 2004/0154863 | A1* | 8/2004 | Green | A63B 27/00 182/7 |
| 2006/0137097 | A1* | 6/2006 | Frost | A61F 5/05825 5/628 |
| 2007/0083975 | A1 | 4/2007 | Senegal | |
| 2008/0282442 | A1* | 11/2008 | Bauvois | A62B 35/0006 2/227 |
| 2009/0178194 | A1 | 7/2009 | Story | |
| 2010/0175175 | A1* | 7/2010 | Helwig | A41D 13/0007 2/456 |
| 2010/0299830 | A1 | 12/2010 | Thomas et al. | |
| 2011/0214212 | A1 | 9/2011 | Marx et al. | |
| 2012/0222912 | A1* | 9/2012 | Wood | A62B 1/14 182/6 |
| 2012/0240332 | A1* | 9/2012 | Palay | A61G 7/1023 5/652 |
| 2013/0037347 | A1* | 2/2013 | Wood | A62B 35/0025 182/6 |
| 2013/0116604 | A1* | 5/2013 | Morilla | A63G 9/12 601/33 |
| 2013/0205466 | A1* | 8/2013 | Arnold | A61G 7/1051 2/69 |
| 2015/0047120 | A1* | 2/2015 | Partridge | A61G 7/001 53/396 |
| 2015/0359272 | A1 | 12/2015 | Murphy et al. | |
| 2016/0236017 | A1* | 8/2016 | Gross | A62B 1/10 |
| 2016/0311661 | A1* | 10/2016 | Schroeder | A61G 7/1023 |
| 2017/0165145 | A1* | 6/2017 | Aryananda | A61H 3/04 |
| 2017/0281989 | A1* | 10/2017 | Wood | A62B 35/0025 |

FOREIGN PATENT DOCUMENTS

| | | | | |
|---|---|---|---|---|
| EP | 2570106 | A2 | 3/2013 | |
| JP | H06-304196 | A | 11/1994 | |
| JP | H06304196 | A * | 11/1994 | A41D 13/12 |
| JP | KPH06304196 | A * | 11/1994 | A41D 13/12 |
| JP | 20050312600 | A | 11/2015 | |
| JP | 2016-017246 | A | 2/2016 | |
| JP | 2016017246 | A * | 2/2016 | A41D 13/12 |
| KR | 2017-0052769 | A | 5/2017 | |
| WO | WO-2017/153623 | A1 | 9/2017 | |
| WO | WO-2018/193225 | A1 | 10/2018 | |

OTHER PUBLICATIONS

Intellectual Property Office, Great Britain Search Report for Great Britain Patent Application No. GB 1705748.0, dated Dec. 27, 2017, (2 pages), Yorkshire, United Kingdom.

Intellectual Property Office, Great Britain Search Report for Great Britain Patent Application No. GB 1805861.0, dated Sep. 28, 2018, (5 pages), Yorkshire, United Kingdom.

International Searching Authority, International Search Report and Written Opinion for International Application No. PCT/GB2018/050938, dated Jun. 1, 2018, (7 pages), The Netherlands.

European Communication Pursuant to Article 94(3) for European Patent Application No. 18719243.0, dated Oct. 23, 2020, (6 pages), European Patent Office, Rijswijk, Netherlands.

* cited by examiner

GARMENT

CROSS REFERENCE TO RELATED APPLICATIONS

This application is a National Stage Application, filed under 35 U.S.C. § 371, of International Application No. PCT/GB2018/050938, filed Apr. 9, 2018, which claims priority to and the benefit of United Kingdom Application No. 1705748.0, filed Apr. 20, 2017; the contents of both of which as are hereby incorporated by reference in their entirety.

BACKGROUND

Related Field

The present invention relates to a garment. In particular, but not exclusively, the present invention relates to a garment for moving or lifting an incapacitated person, such as an elderly person or patient, wearing the garment.

Description of Related Art

A person may become incapacitated as a result of an illness, disease, operation, accident and/or condition which prevents that person from independently moving from one position/location to another. Such incapacitation typically results in that person being bed bound either in their own home, a care home, a hospital, or the like, and performing otherwise simple tasks such as rolling over in bed, sitting up in bed, moving from a bed to a chair or to the bathroom, is often particularly difficult if not impossible. Being static in a bed for a prolonged period of time can lead to rapid muscle loss, arthritis and/or bed sores, particularly for elderly people, so frequent movement is vital. Washing and other hygiene tasks are also vital. Incapacitated people, such as a patient or the elderly, who are unable to perform such tasks independently are therefore often cared for by at least one care person or nurse. However, moving and/or lifting an incapacitated person, particularly a relative heavy person, can be particularly difficult if not impossible, especially for single care person or nurse. As such, it is known for a care person or nurse to use a lifting apparatus, such as a hoist, to help move, lift and/or manoeuvre the incapacitated person from, for example, a lying position in a bed to a sitting position in a chair, wheelchair, or toilet, or the like. A hoist typically includes a hook or shackle for attaching to a sling for supporting and lifting the incapacitated person. The sling is first fitted underneath or around the person before the lifting apparatus is attached thereto for lifting the person into a different position and/or location.

However, a conventional sling can be uncomfortable for an incapacitated person, particularly an elderly person with significant weight and muscle loss, in view of the sling digging into the body and causing pain/bruising. It is also particularly difficult for one or more care people or nurses to manoeuvre an incapacitated person into a number of different positions to allow the sling to be properly and securely fitted to the person before being lifted by a lifting device. It can also be uncomfortable and often embarrassing for the incapacitated person when being manoeuvred around, e.g. in bed, whilst the sling is being fitted in a correct and secure manner, particularly if the sling fits around the chest and/or crotch area. Such a process is therefore time consuming and costly and must be repeated each and every time an incapacitated person requires moving/lifting.

BRIEF SUMMARY

It is an aim of certain embodiments of the present invention to provide a garment for moving or lifting an incapacitated person wearing the garment.

It is an aim of certain embodiments of the present invention to provide a garment which can be easily fitted to an incapacitated person for an extended period of time whilst allowing a lifting device to be efficiently coupled to the garment for moving or lifting the person on a number of separate occasions during that period of time.

It is an aim of certain embodiments of the present invention to provide a garment which may be worn by an incapacitated person during the day and night without compromised comfort, and which is configured to be efficiently coupled to a lifting device as and when required.

According to a first aspect of the present invention there is provided a garment for moving an incapacitated person, comprising:

a wearable body portion; and a support portion comprising a plurality of attachment elements attachable to a lifting device, wherein the plurality of attachment elements comprises a first attachment element located at a first location on a first side of a sagittal plane of the garment and a second attachment element located at a second location on a second side of the sagittal plane and substantially opposed to the first location.

Optionally, the support portion is detachable with respect to the body portion.

Optionally, the support portion comprises a spine element from which each attachment element extends.

Optionally, at least some of the attachment elements extend substantially laterally from the spine element.

Optionally, the spine element extends at least partially along a back side of the body portion and is disposed substantially on the sagittal plane.

Optionally, each attachment element is substantially elongate having a first end region extending from the spine element and a free second end region.

Optionally, each attachment element substantially tapers from a relatively wide first end region to a relatively narrow second end region.

Optionally, the second end region comprises a coupling element for coupling the respective attachment element to a lifting device.

Optionally, the coupling element comprises an eyelet.

Optionally, the second end region comprises a connecting element to removably connect the second end region to the body portion or support portion.

Optionally, respective second end regions of at least one corresponding pair of the plurality of attachment elements are connectable to provide a strap-like portion across a front side of the body portion.

Optionally, a corresponding pair of the plurality of attachment elements is disposed at any one or more of a shoulder region, an armpit region, a torso region, a waist region, a hip region, and a leg region of the garment.

Optionally, the body portion comprises sleeve portions.

Optionally, the body portion and/or the support portion comprise a polymer.

Optionally, the support portion comprises Nylon™.

According to a second aspect of the present invention there is provided apparatus for attaching to a garment for moving an incapacitated person, comprising:

a support portion for removably attaching to a garment; and a plurality of attachment elements extending from the support portion for attaching to a lifting device, wherein the plurality of attachment elements comprises a first attachment element locatable at a first location on a first side of a sagittal plane of the garment and a second attachment element locatable at a second location on a second side of the sagittal plane and substantially opposed to the first location.

Optionally, the support portion comprises a spine element from which each attachment element extends.

Optionally, at least some of the attachment elements extend substantially laterally from the spine element.

Optionally, the spine element is configured to extend at least partially along a back side of a garment and is locatable substantially on the sagittal plane.

Optionally, the apparatus further comprises at least one coupling element for removably attaching the support portion to a garment comprising a corresponding coupling element.

According to a third aspect of the present invention there is provided a garment comprising apparatus according to the second aspect of the present invention for moving an incapacitated person.

According to a fourth aspect of the present invention there is provided a use of a garment according to the first or third aspects of the present invention to move an incapacitated person with a lifting device.

According to a fifth aspect of the present invention there is provided a system for moving an incapacitated person, comprising:

a garment according to the first or third aspect of the present invention; and a support sling comprising a pair of leg support members and a back support member, wherein each leg support member is connected or connectable to the back support member and wherein the support sling is connectable to a first pair of opposed attachment elements of the support portion of the garment.

Optionally, each leg support member is connected or connectable to the back support member by a respective one of two connecting regions each comprising at least one connecting element to releasably connect the sling to a respective one of the attachment elements.

Optionally, each connecting region is adapted to connect a first end region of a respective one of the leg support members to a respective end region of the back support member and to connect the sling to the attachment elements.

Optionally, each connecting region comprises three connecting straps extending from a common ring element to define a substantially Y-shaped connecting region.

Optionally, the at least one connecting element comprises a carabiner.

Optionally, the system further comprises a plurality of lifting straps for connecting the sling and a further pair of opposed attachment elements of the support portion of the garment to a hoist.

Optionally, the system further comprises a hoist.

According to a sixth aspect of the present invention there is provided a method of moving an incapacitated person, comprising:

locating a garment according to the first or third aspect of the present invention on a person;

connecting a first end of a first lifting strap to a first attachment element of the garment and a second end of the first lifting strap to a hoist;

connecting a first end of a second lifting strap to a second attachment element of the garment and a second end of the second lifting strap to the hoist, wherein the second attachment element is located opposite the first attachment element with respect to a sagittal plane of the person;

applying a lifting force to the attachment elements by the hoist to move the person.

Optionally, the first and second attachment elements are located proximal a shoulder region of the garment.

Optionally, the method further comprises locating a leg support member of a sling under a respective upper leg of the person and attaching a first end region of each leg support member to a respective one of a pair of opposed further attachment elements of the garment.

Optionally, each of the further attachment elements is located proximal an armpit region of the garment.

Optionally, the method further comprises connecting the first end regions of each leg support member to a back support member of the sling.

Optionally, the method further comprises connecting a first end of at least one further lifting strap a second end region of one or both of the leg support members and a second end of the further lifting strap to the hoist.

Optionally, the method further comprises applying a lifting force to the sling by the hoist to move the person.

BRIEF DESCRIPTION OF THE FIGURES

Certain embodiments of the present invention will now be described with reference to the accompanying drawings in which.

DETAILED DESCRIPTION OF VARIOUS EMBODIMENTS

Figure 1:
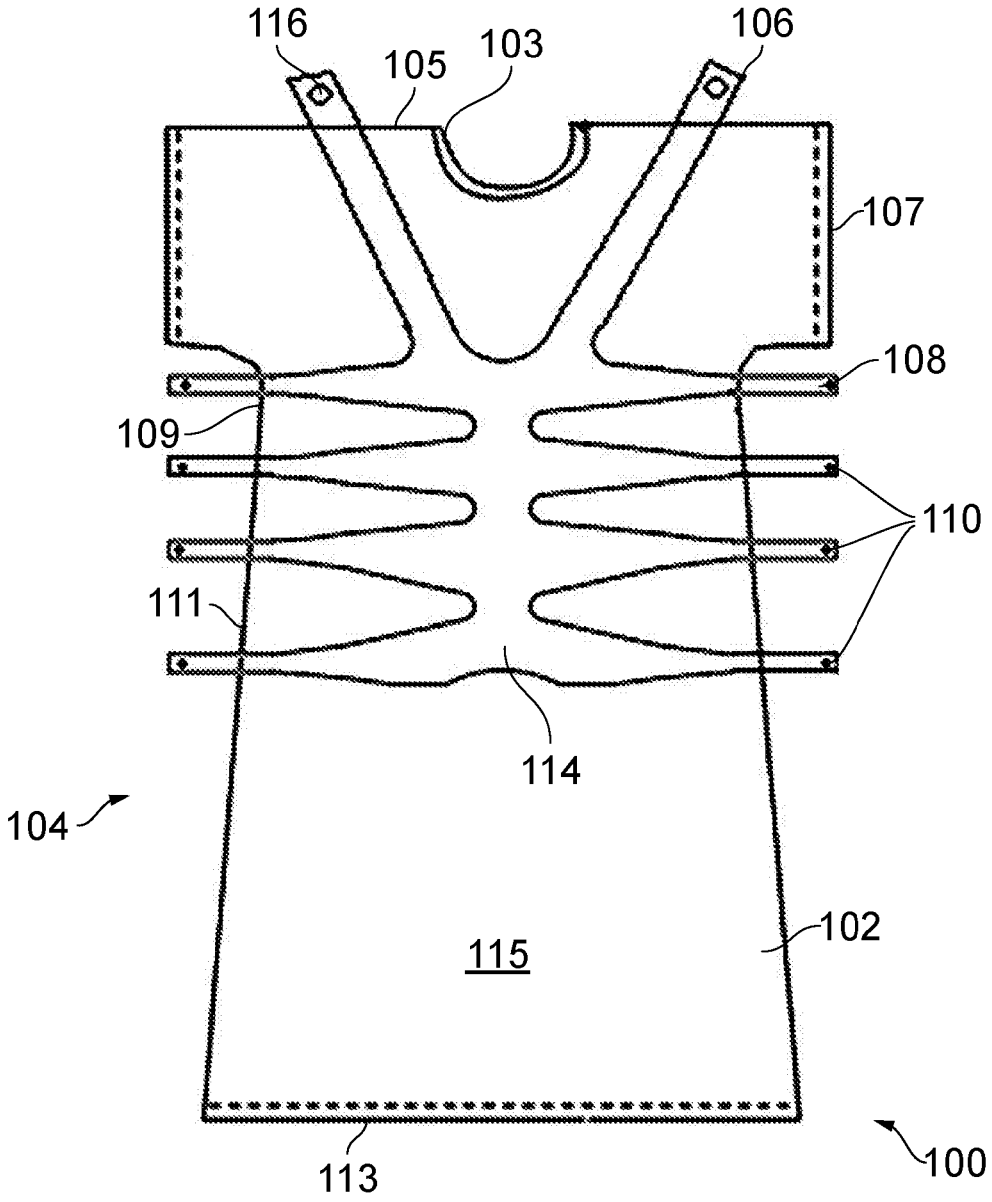
FIG. 1 illustrates the back side of a first garment according to certain embodiments of the present invention.

As shown in FIG. 1, a garment 100 according to certain embodiments of the present invention includes a wearable body portion 102 and a support portion 104 providing a plurality of attachment elements 106,108,110 at a number of predetermined locations on the body portion 102 for coupling a lifting device, such as a patient hoist, to the garment.

Alternatively, or additionally, one or more of the attachment elements may provide a handle for at least one care person to use to manually move or lift the incapacitated person wearing the garment 100. The body portion 102 of the garment 100 shown in FIG. 1 includes a neck region 103, a shoulder region 105 which terminates in relatively short sleeve regions 107, an armpit region 109, and a torso region 111 which terminates at a waist region 113 to represent a relatively short medical gown. The front of the garment (not shown) may be open and include a number of buttons or a full length zip for ease of fitting and closing. Alternatively, the garment made be substantially closed at the front and fitted to a person by placing the same over the head of that person.

An attachment element 106 is provided at each shoulder region 105 of the garment 100. An attachment element 108 is also provided at each armpit region 109 of the garment 100. A plurality of attachment element 110 are further provided at least partially along each side of the torso region 111 of the garment 100. Each attachment element is substantially elongate and has a length to allow the same to extend from the back side 115 of the garment to the front side (not shown) of the garment. For example, each of the armpit attachment elements 108 and/or one or more of the torso attachment elements 110 may be configured to extend around the outside of each arm of a wearer of the garment to inwardly constrain and protect the wearer's arms from lifting straps, for example, during a lifting operation.

Each of the attachment elements 106,108,110 extends from one side of the garment 100 and has an opposed corresponding attachment element extending from the other side of the garment to ensure a person wearing the garment 100 is in a balanced state when being lifted by a lifting device, e.g. patient hoist, which may be attached to at least two or more opposed ones of the attachment elements as required. One or more opposed pairs of the attachment elements, e.g. the armpit attachment elements 108, may aptly include corresponding connection elements, e.g. a buckle or shackle, at their free end regions to allow the same to connect together across the front side of the garment, e.g. across a wearer's chest, to provide greater security, support and balance to the garment and the wearer when being lifted.

Furthermore, providing opposed corresponding pairs of attachment elements 106,108,110 also ensures an attachment element is always available irrespective of which side a person is lying on, e.g. in bed, or which side of a person is accessible to a lifting device. As an example, if a patient is lying on one side in bed and needs rolling over to lie on the other side, one or more of the attachment elements extending from the available side of the garment 100 may be used to manoeuvre the patient on his/her other side. If, for example, the patient needs lifting into an upright position in the bed, for example, one or more of the attachment elements extending from the available side of the garment may be attached to a lifting device for efficiently manoeuvring the patient into a position wherein at least some of the attachment elements on the opposed side of the garment are available. Opposed ones of the attachment elements, aptly around the upper torso region 111 and shoulder region 105, can then be attached to the lifting device to lift the patient into the upright position.

To help evenly distribute the loads subjected to the garment and the patient in use, and to ensure the garment itself is sufficiently durable yet comfortable to wear during daylight and night time hours, the plurality of attachment elements 104 each extend outwardly from an elongate and longitudinally oriented spine element 114 of the support portion 104. The spine element 114 extends at least partially along the length of the garment 100 and is located substantially centrally along the back side 115 of the garment 100 to substantially align longitudinally with at least a portion of the wearer's spine region. Likewise, the elongate attachment elements 106,108,110 may aptly substantially align with a portion of the wearer's ribcage when extended around the torso region 111 for example. At least the spine element 114 is fixed to the garment 100 by suitable means, such as adhering and/or stitching or the like. Alternatively, the spine element 114 of the support portion 104 may be removably attachable to a garment 100 as required. For example, in accordance with certain embodiments of the present invention, a support portion 104 may be provided for attaching to a garment worn by an incapacitated person to efficiently manoeuvre that person as and when required. At least the spine element 114 may aptly include a first part of a coupling arrangement, e.g. one or more pads or strips including the hook parts of a Velcro™ arrangement, and the garment 100 may include the other part of the coupling arrangement, e.g. one or more pads or strips including the hoop parts of a Velcro™ arrangement. Other forms of coupling arrangements can be envisaged to removably attach the support portion 104 to the backside of a garment 100 in accordance with certain embodiments of the present invention, such as press-studs, buttons, zips, eyelet and lace arrangement, or the like. A detachable support portion desirably allows the body portion 102 to be worn without the support portion 104 attached thereto when the same is not required, whilst allowing the support portion 104 to be efficiently attached to the body portion 102 when required. A detachable support portion is aptly universal and may be attachable to a number of different garments worn by different patients as and when required which desirably saves on cost, material, washing etc. The body portion 102 can also be easily washed or disposed of without having to wash or dispose of the support portion 104 which may be washed separately and reused. Whilst conventional slings/harnesses are particularly uncomfortable and difficult to fit to an incapacitated person, the material used is typically a composite of two or more different materials which react differently when subjected to increased temperature. As a result, it is known for such conventional harnesses/slings to warp when washed at relatively a high temperature of, for example, around 80° C. which is known for medical/hygiene applications. Further alternatively, where the support portion 104 includes one or more straps extending around the front side of the wearer, a coupling arrangement to attach the support portion 104 to the body portion 102 of a garment 100 may not be required.

Each attachment element 106,108,110 includes a coupling element 116, e.g. an eyelet, loop, D-ring, or the like, at its free end region for coupling a hook or shackle of the lifting device to a respective attachment element. Aptly, a suitably sized and shaped coupling element, such as a loop or D-ring, may be used by a care person to manually move a patient wearing the garment. The body portion 102 of the garment 100 ensures the loading subjected to the garment and in turn the patient is applied substantially evenly and over a relatively large area to reduce/eliminate the risks of load concentrations etc. being undesirably applied to the patient which could otherwise result in pain, injury and/or bruising or the like.

Each attachment element 106,108,110 aptly includes a connection element (not shown), such as one of a hook and loop of a Velcro™ patch, or a press-stud, button, or the like, for connecting with a corresponding element on the body portion 102, e.g. front or side of the garment, to allow the free end regions of each attachment element to be connected to the body portion when not in use and to avoid the same flapping around and/or causing discomfort to the wearer, particularly during sleeping hours.

The body portion 102 is aptly a lightweight yet durable material, such as polycotton, but may comprise any suitable woven or non-woven material such cotton, plastic, or the like. The support portion 104 and attachment elements 106,108,110 extending therefrom aptly are/comprise the same or a different material to the body portion, such as Conex™, Kevlar™, Nomex™, Twaron™, Dyneema™, Vectran™, PBI, Nylon™, graphene, acrylic, modacrylic, viscose, wool, cotton, anti-static, elastomeric, polyester, polypropylene, PEEK, or the like, and any blend of such fibres. Aptly, the chosen material for the support portion has a relatively high tensile strength to withstand supporting and lifting loads. A suitable fabric for the support portion is PS4011 nylon high tenacity fabric. This fabric is manufactured using high tenacity (HT) yarns offering high strength, it does not deteriorate or breakdown through age, it has a particularly high resistance to abrasion to withstand scraping, bending and twisting without breaking down, and the fabric is heat set but also includes a heat resistant additive to offer good heat resistance and ultra violet stability, again enhancing the wear life of the product. Furthermore, nylon fibre is not particularly absorbent to moisture so in relatively hot conditions the fabric does not gain much weight, it is easy to clean and wash using a damp cloth, and it is resistant to mildew.

Figure 2A:
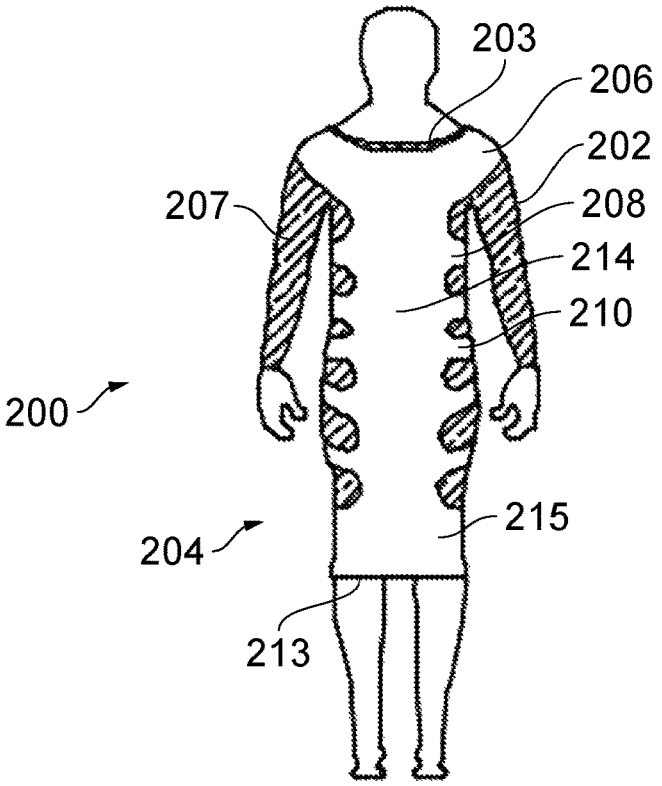
FIG. 2*a* illustrates the back side of a further garment according to certain embodiments of the present invention.
Figure 2B:
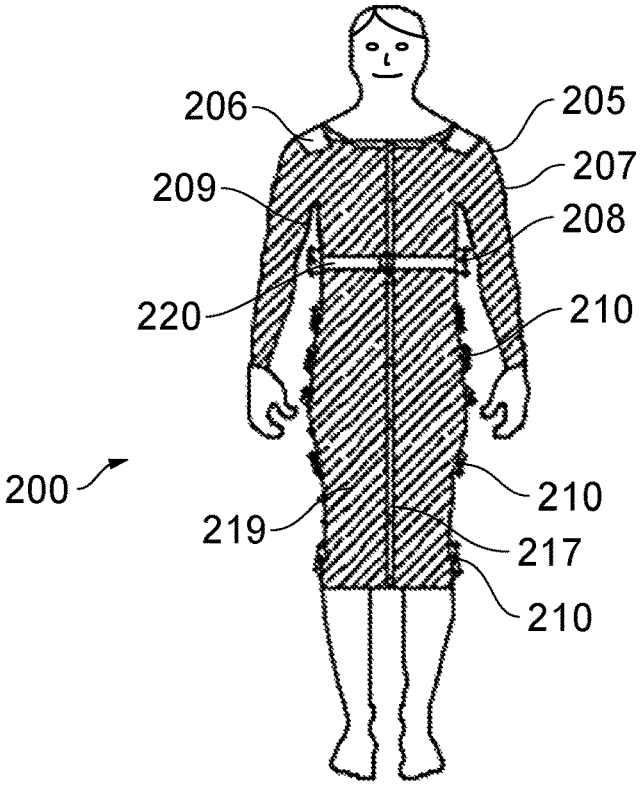
FIG. 2*b* illustrates the front side of the garment of FIG. 2*a;*

A further garment 200 according to certain embodiments of the present invention is shown in FIGS. 2*a* and 2*b*. The wearable body portion 202 includes full length sleeve portions 207 and extends to below the knee of a wearer to provide a relatively long medical gown/nightie which includes a full length zip 217 or row of buttons up the front side 219 (as shown in FIG. 2*b*). The back side 215 of the garment is shown in FIG. 2*a* and includes a support portion 204 having a relatively wide spine element 214 attached to the back side of the body portion 202. The support portion 204 extends from the neck region 203 of the body portion 202 to the lower end region 213 of the body portion 202. A relatively wide attachment element 206 extends over each shoulder region 205 and is attachable to a front side of the respective shoulder region when not in use as described above. A further attachment element 208 extends from under each armpit region 209, or around the outside of each arm, and each is aptly connectable together to provide a strap 220 across the chest of the wearer as shown in FIG. 2*b*. One or both of these armpit attachment elements 208 aptly includes a coupling element, such as a D-ring, at its free end for a lifting device to attach to at a central point relative to a wearer of the garment 200. A suitably sized D-ring may also be used as a handle by a care person to manually manoeuvre a wearer of the garment as required. Alternatively, each of these armpit attachment elements 208 may terminate around the armpit/arm region 209 and have a coupling element to allow a corresponding part of a strap to attach and extend between the pair of opposed attachment elements 208 to thereby provide a central lifting point on the chest region of the wearer. Such a central point at the chest region and under the armpits provides for balanced and secure lifting of a patient, particularly from a lying down position to an upright position. Additional pairs of attachment elements 210 extend from, and are longitudinally spaced apart along, the central spine portion 214 to provide further attachment points along the garment 200 for a lifting device to lift a wearer of the garment from predetermined locations on the wearer's body.

As illustrated in FIGS. 2*a* and 2*b*, attachment elements 206,208,210 are therefore provided at each shoulder region 205, each armpit region 209, around the waist and hip regions, at the upper leg region, and at the knee region. More or less attachment points in accordance with certain embodiments of the present invention can be provided and at different locations on the garment as required. A head portion may also be provided to support a person's head when being lifted, particularly when in a substantially horizontal orientation. The head portion may be coupled directly to the garment or to the shoulder attachment elements 206 by suitable means, such as fabric, straps, or the like, and may aptly couple at a region distal to the garment to one or more lifting straps of a lifting device. The head portion may include one or more straps/bands for securing the head portion to the head of a person being moved/lifted, e.g. a strap fitted around the forehead of the person. The head portion may include one or more attachment elements for attaching to a lifting device. The head portion may also include a coupling element, e.g. Velcro™ or the like, to couple the head portion to the back of the garment when the head portion is not in use. One or more crotch straps may also be provided on the garment and/or support portion to offer additional support and security and in particular to prevent the garment moving upwardly relative to the patient when in use.

Figure 3A:
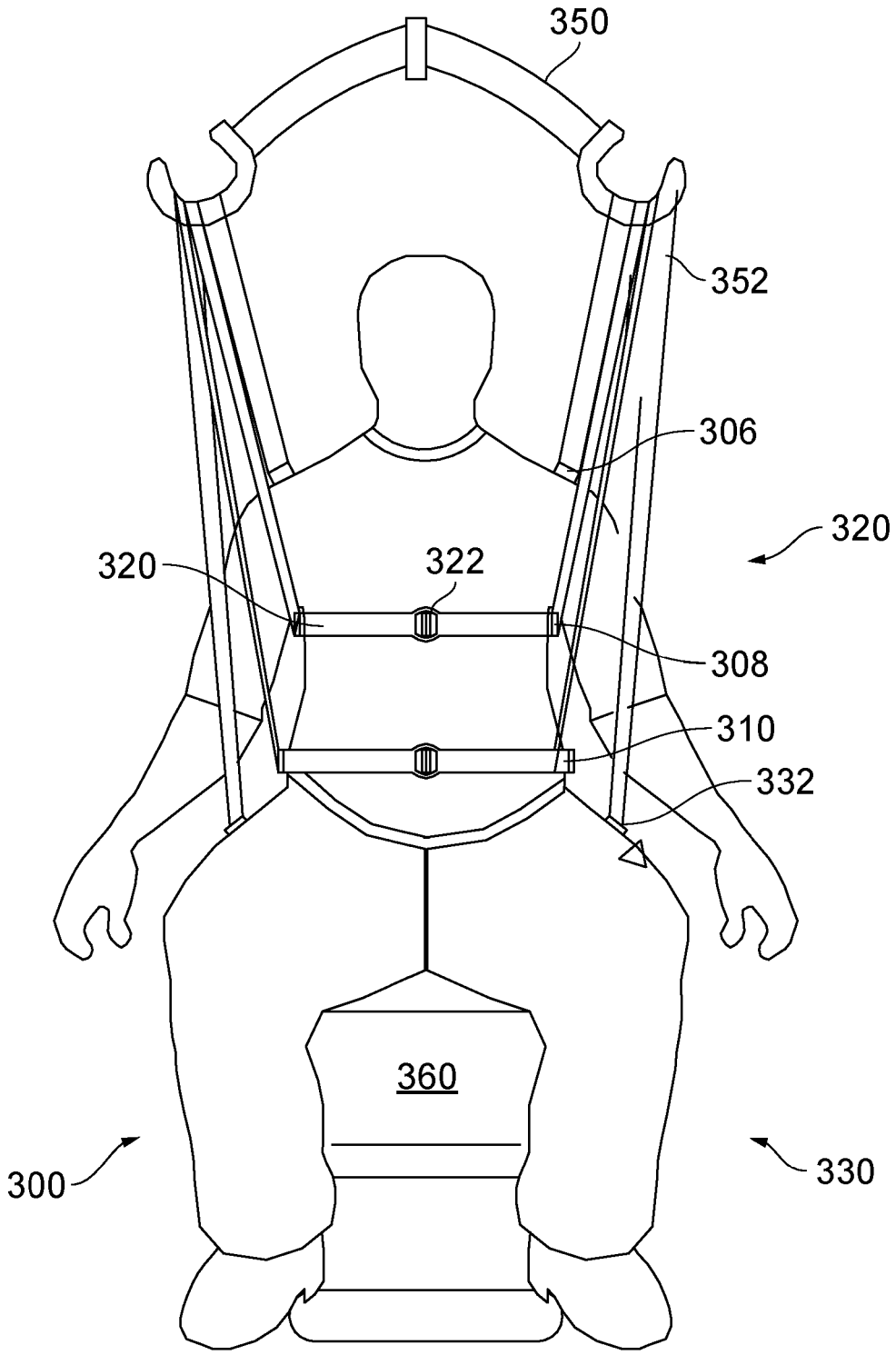
FIG. 3*a* illustrates a person wearing a garment according to certain embodiments of the present invention being lowered on to a toilet by a lifting device.
Figure 3B:
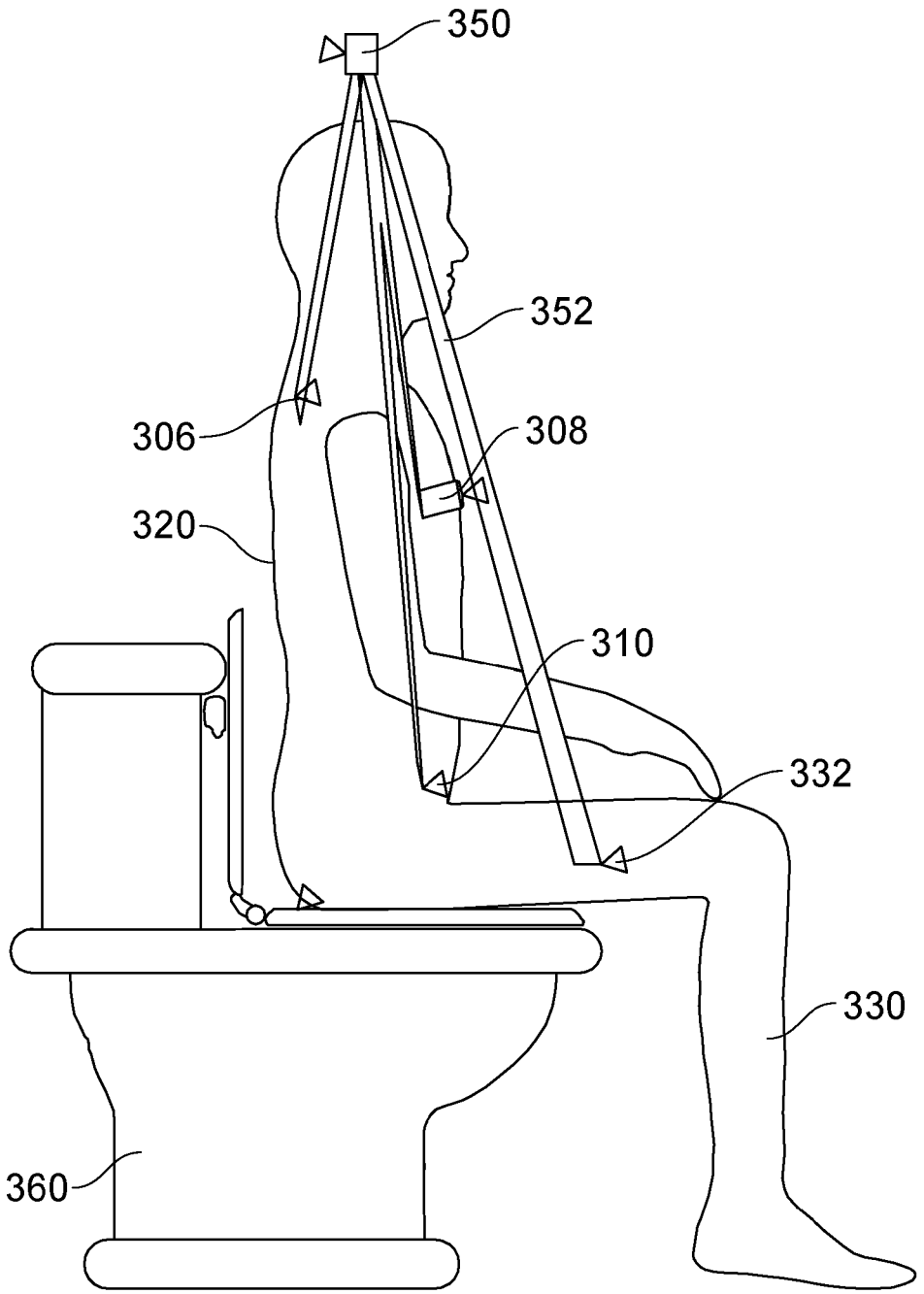
FIG. 3*b* illustrates a side view of the person in FIG. 3*a;*
Figure 4:
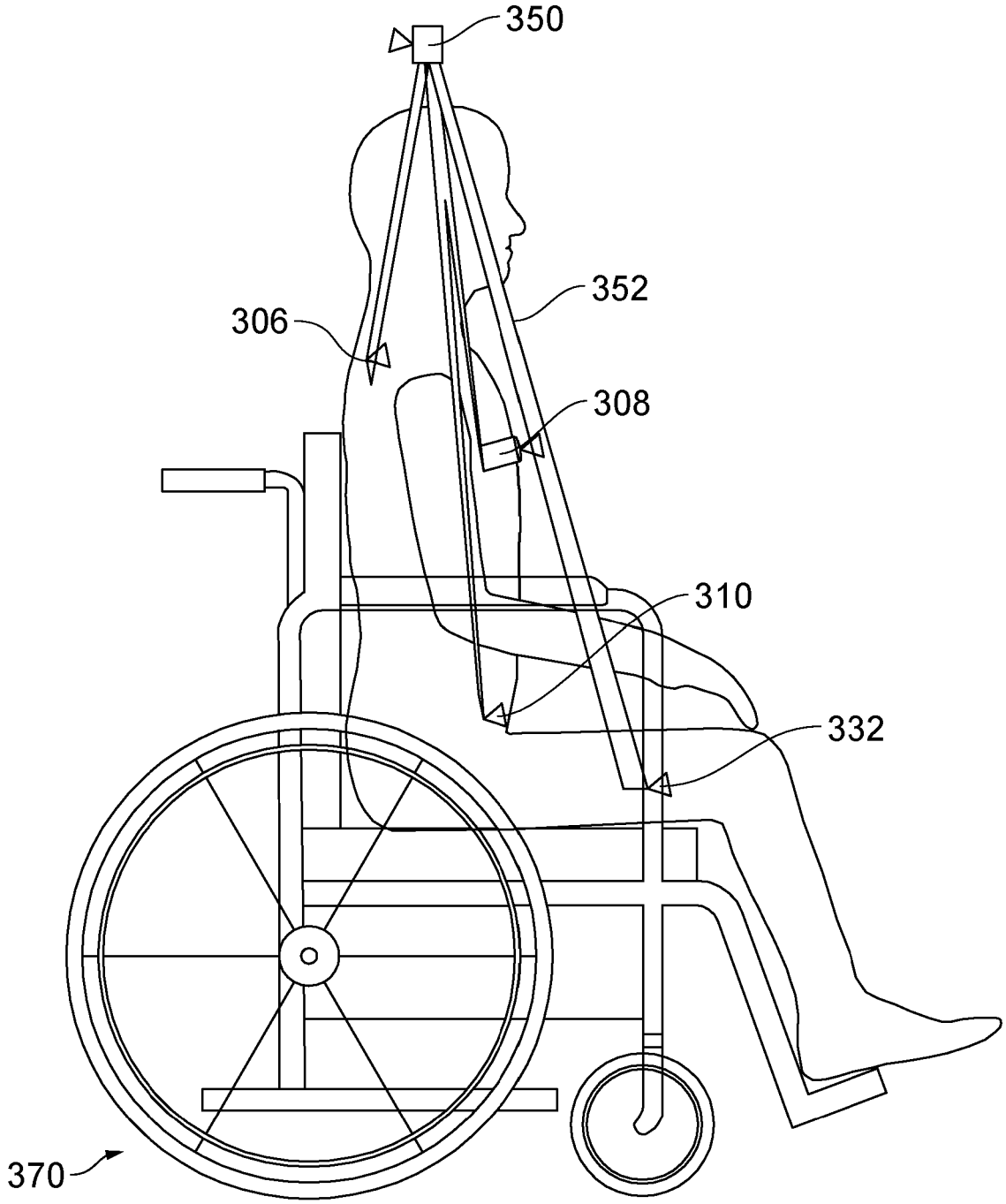
FIG. 4 illustrates a person wearing a garment according to certain embodiments of the present invention being lowered into a wheel chair by a lifting device.

In accordance with certain embodiments of the present invention, a person can wear the garment during normal use, i.e. during the day and whilst sleeping when not being moved or lifted, and can easily and quickly be coupled to a lifting device, such as a patient hoist, by at least one care person as and when required without the patient having to be laboriously moved/manhandled into a number positions for a conventional wearable lifting apparatus, such as a harness, to be fitted. The plurality of different attachment elements 104,204 allows the person to be securely, safely and comfortably moved or lifted in a number of different ways from at least one location with respect to the body. For example, as illustrated in FIG. 3*a*, the upper portion 320 of a two-piece garment 300 according to certain embodiments of the present invention includes a pair of opposed attachment elements 306 provided at opposed shoulder regions thereof, a pair of opposed attachment elements 308 at each armpit region thereof, and a pair of opposed attachment elements 310 at respective sides of the waist region of the garment. As such, each corresponding pair of attachment elements is disposed on a respective and opposed side of the sagittal plane (SP) (i.e. from front to back through the vertical axis of a person). Aptly, each attachment element is disposed substantially on the frontal plane (i.e. from side to side through the vertical axis and perpendicular to the sagittal plane (SP)). Each of the armpit and waist attachment elements 308,310 aptly extends to a central point 322 at the front side of the upper garment portion 320 and is adapted to connect together, by buckle elements or the like, to provide a form of strap around the front of a wearer for additional security and improved load distribution and comfort when the person is being lifted. Alternatively, each corresponding pair of these attachment elements is connectable by an adjustable strap portion 320 extending therebetween. Suitable connection elements, e.g. buckle parts, of these attachment elements, or a strap itself, may provide a centrally located lifting/attachment element 322, such as a D-ring, shackle, or the like for lifting the patient from a single, centrally located point between opposed attachment elements. Such a central point aptly lies on the sagittal plane (SP) of the person. A lower portion 330 of the garment 300 includes a pair of opposed attachment elements 332 at upper leg regions thereof. Such a garment 300 allows a patient hoist 350 to be coupled via suitable straps 352 to the garment 300 and a patient wearing the same at suitable locations for safely supporting the patient at the shoulder, armpit, waist and upper leg regions. A lifting device is attachable to at least one pair of opposed attachment elements such that the lifting device/lifting straps/slings do not impede patient's face or limbs during a lifting operation. The attachment elements at the upper leg regions support each leg of the patient in an upright manner such that the patient in a sitting position to allow the same to be efficiently moved to and from a sitting position, e.g. a toilet 360 (as shown in FIGS. 3*a* and 3*b*) or a wheelchair 370 (as shown in FIG. 4), for example.

Figure 5:
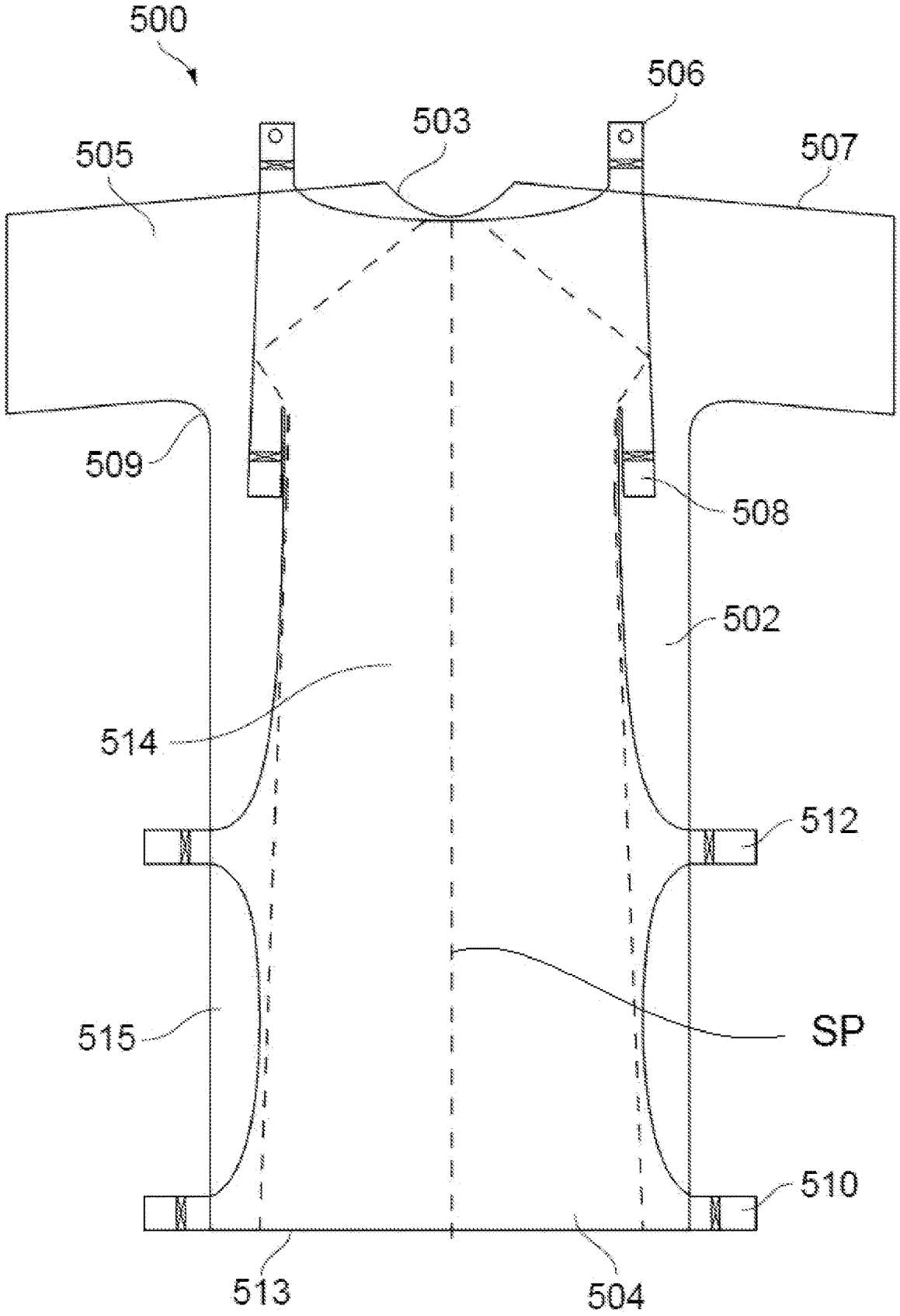
FIG. 5 illustrates the back side of a further garment according to certain embodiments of the present invention.

A further garment 500 according to certain embodiments of the present invention is shown in FIG. 5. The wearable body portion 502 includes short sleeve portions 507 and extends to below the knees of a wearer to provide a relatively long medical gown which includes a full length, two-way zip on the front side (not shown) of the garment. The back side 515 of the illustrated garment 500 includes a support portion 504 having a relatively wide spine element 514 attached to the back side of the body portion 502 by stitching 550 as illustrated in dashed lines. The support portion 504 extends the full length of the garment from the neck region 503 to the lower end region 513 of the body portion 502. A pair of lower opposed attachment elements 510 extend from the spine element 514 at the lower end region of the garment, and a pair of intermediate opposed attachment elements 512 extend from the spine element 514 approximately midway between the lower end region 513 and the armpit region 509 of the garment. A further pair of opposed attachment elements 508 extend from an upper portion of the spine element 514 proximal the armpit region 509 of the garment and a further pair of opposed attachment elements 506 extend from an upper edge region of the spine element 514 proximal the shoulder region 505 of the garment. Optionally, the garment 500 may include one or more further attachment elements extending from the lower edge region of the back side of the garment and proximal the sagittal plane (SP) such that they may extend forwardly and between the legs of a wearer in use if a lifting point at such a location is desired. Aptly each attachment element is a reinforced loop of material for attaching a hook, clip, carabiner, or the like, to when lifting of the wearer by a hoist is required.

Figure 6A:
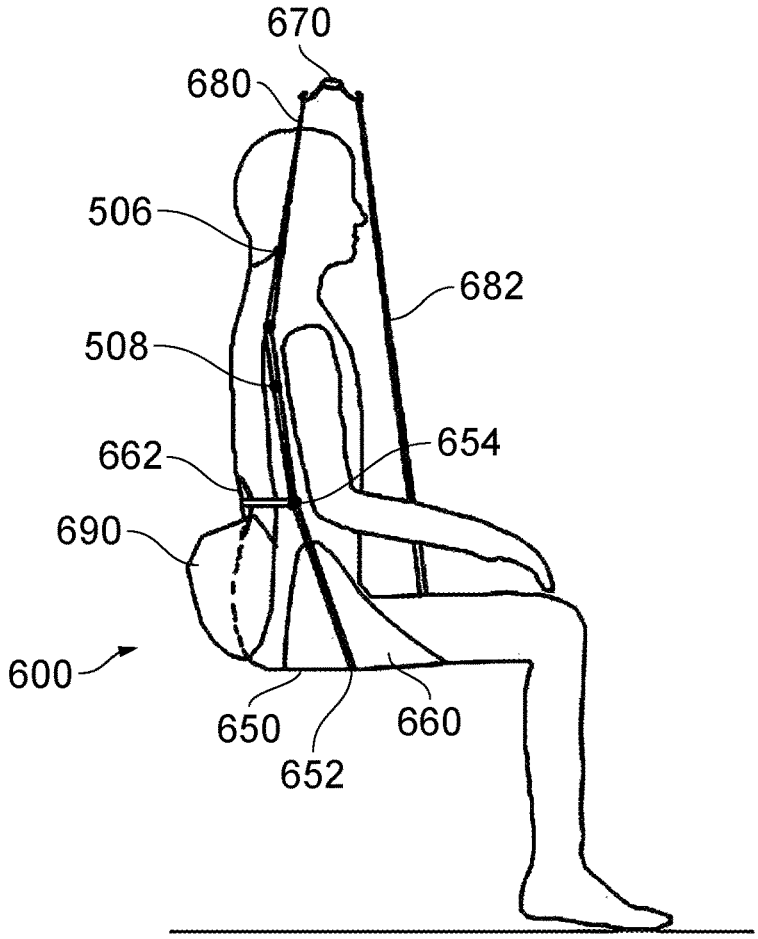
FIG. 6*a* illustrates a system for moving an incapacitated person comprising a garment and a sling according to certain embodiments of the present invention.
Figure 6B:
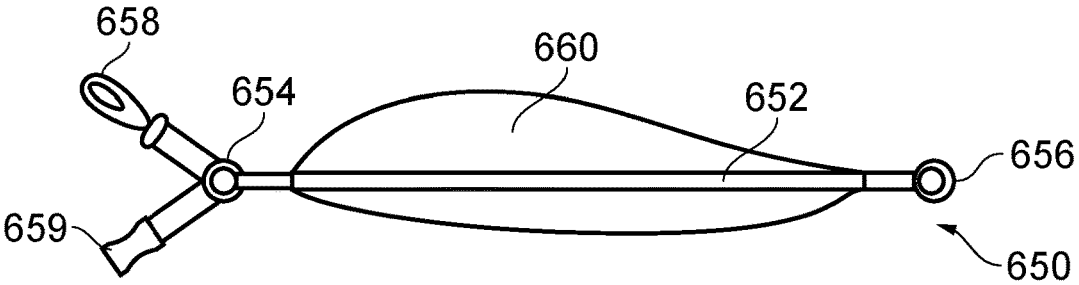
FIG. 6*b* illustrates a leg support member of the sling of FIG. 6*a*.

As illustrated in FIG. 6*a*, the garment according to certain embodiments of the present invention may be used with a sling/harness 600 to support and orient a patient in a desired position for a particular need, such as lifting on/off a toilet. The sling 600 includes a pair of leg support members 650 for supporting a patient's upper leg during lifting. As shown in FIG. 6*b*, each leg support member 650 comprises a support strap 652 having a first D-ring 654 or the like provided at one end. At least one of the leg support members 650 may have a second D-ring 656 or the like provided at the other end of the support strap. A carabiner 658 or the like and a female connector 659 or the like are coupled by webbing to the first D-ring 654 to form a Y-shaped arrangement, as illustrated in FIG. 6*b*. Between the two ends of the support strap 652 is located a leg support portion 660 which is adapted to support the upper leg of a patient in a secure and comfortable manner. As shown in FIG. 6*b*, the support portion 660 extends outwardly from each end region of the strap to provide a relative wide support region between the two ends. Each leg support portion 660 is aptly a padded construction.

Figure 6C:
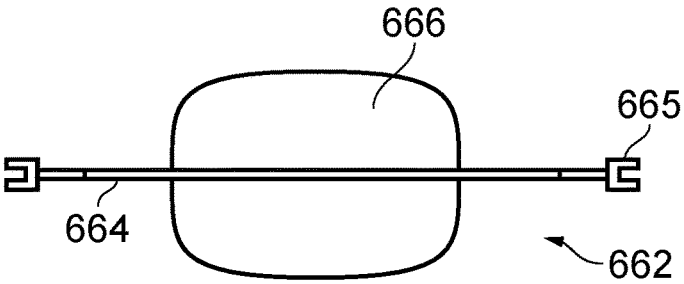
FIG. 6*c* illustrates a back support member of the sling of FIG. 6*a*.

As illustrated in FIG. 6*c*, the sling 600 further includes a back support member 662 which also includes a support strap 664 having a male connector 665 or the like at each end for coupling with the female connector 659 attached to a respective one of the pair of leg support members 650. Alternatively, each end of the support strap 664 of the back support member 662 may be directly connected, either permanently or releasably, to the D-ring 654 or the like of each leg support member 650. The back support member 662 includes a back support portion 666 provided between the ends of the support strap 664 for supporting a patient's back during lifting to prevent the patient rotating backwards. The back support portion 666 is aptly a padded construction.

In use, each of the upper attachment elements 506 located proximal the shoulder region 505 of the garment are attached to a lifting hoist 670 by suitable means, e.g. a strap 680 having a loop at one end attachable to the hoist and a carabiner at the other end attachable to the shoulder attachment elements 506 of the garment 500. Each leg support member 650 is positioned under a respective upper leg of the patient and the carabiner 658 or the like of each Y-shaped arrangement thereof is attached to a respective one of the armpit attachment elements 508. This provides additional support and security to a patient when being lifted. The support strap 664 of the back support member 662 is coupled to the leg support members 650 by way of the male/female connectors 665/659 and adjusted accordingly to ensure a snug and secure fit with respect to the patient. The other ends of the support strap 652 of each leg support member 650 are brought together between the patient's upper legs such that an end of one of the leg support straps 652 is fed through the second D-ring or the like of the other one of the leg support members. This arrangement secures the ends of each leg support strap 652 together during lifting. Suitable lifting straps 682 are attached to the ends of each leg support member 650 and the hoist 670. Optionally additional straps (not shown) may be provided to couple the hoist 670 with each of the intermediate attachments elements 512 of the garment to provide additional support and security to a patient being lifted. Such additional straps would desirably extend laterally of the arms of the patient to desirably contain the arms inside the straps during lifting. When the patient has been lifted and manoeuvred into a desired position, e.g. on to a toilet, the optional lifting straps can be detached from the garment to allow a lower back portion 690 of the garment to be lifted upwardly. The lower attachment elements 510 can then be clipped on to the carabiners or the like which are already attached to the shoulder attachment elements 506 of the garment such that the lower back portion 690 of the garment is held out of the way of the toilet whilst a carer or the like attends to the patient.

Aptly, the lifting straps and attachment elements/lifting points are colour-coded to ensure the correct straps are correctly coupled to the garment and the leg and back support members, and in turn to ensure the process of connecting the same to the hoist, and lifting a patient, is efficient and safe. Alternatively or additionally, the stitching colour of the garment may be colour coded corresponding to different garment sizes to allow a carer to quickly and efficiently select a correctly sized garment for a patient. For example, the stitching of a garment may be black for size extra-large (XL), blue for size large (L), yellow for size medium (M), orange for size small (S), and red for size extra-small (XS).

As such, the attachment elements of a garment 100,200 according to certain embodiments of the present invention may be selectively used by at least one care person to roll, move, lift etc. a patient or incapacitated person from and to a variety of different locations, orientations and positions in a convenient and efficient manner which causes minimum discomfort and inconvenience to the person. The garment can be worn by a disabled or elderly person or fitted to an able person prior to an operation to efficiently move that person during/after the operation whilst that person is unconscious as a result of an anaesthetic for example. The garment according to certain embodiments of the present invention offers the comfort, functionality and privacy of a conventional medical garment, such as a patient's gown, along with the additional technical functionality for moving/lifting the patient in an efficient and discreet manner. The garment may be used with a sling according to certain embodiments of the present invention whereby the sling supports and orients the patient in a desired position and the garment provides additional support and security whilst preventing the patient slipping out of the sling. Alternative forms of garment, other than a medical gown/nightie, for example, can be envisaged within the scope and technical applications of the present invention such as everyday garments for sporting activities, school, social events, concerts, etc. For example, a jacket/blazer for use by a pupil at school, or by an adult at the races, for example, may incorporate the attachment portions to allow an incapacitated person to attend and enjoy such an event. The jacket in accordance with certain embodiments of the present invention thus allows the incapacitated person to be suitably dressed and be moved and lifted into/from a vehicle from/into a wheelchair as required without having to be fitted in an uncomfortable and indiscreet sling/harness on numerous occasions.

The invention claimed is:

1. A garment for moving an incapacitated person, comprising:

a wearable body portion in the form of a gown having a neck region, a shoulder region, a waist region, and an open lower end region relative to the incapacitated person wearing the garment; and a flexible support portion comprising a flexible elongate and longitudinally extending spine element and a plurality of flexible attachment elements attachable to a lifting device, wherein:

the flexible support portion is permanently fixed to an outer surface of a back side of the body portion and extends from the neck region to the lower end region of the body portion, the outer surface of the back side of the body portion has no direct contact with a back of the incapacitated person, the plurality of flexible attachment elements are integrally connected with the spine element, the elongate and longitudinally extending spine element is located centrally along the back side of the body portion to be disposed substantially along a sagittal plane of the garment, the plurality of flexible attachment elements comprises:

a first pair of flexible attachment elements extending outwardly in opposed lateral directions from the spine element with respect to the sagittal plane of the garment and proximal the lower end region of the body portion, a second pair of flexible attachment elements extending outwardly in opposed lateral directions from the spine element with respect to the sagittal plane of the garment and proximal the waist region of the body portion, and a third pair of flexible attachment elements each extending substantially longitudinally from a respective side of the spine element with respect to the sagittal plane of the garment and proximal the shoulder region of the body portion, and the first and the second pair of flexible attachment elements extend entirely across and beyond the outer surface of the back side of the body portion.

2. The garment as claimed in claim 1, wherein each attachment element comprises a first end region extending from the spine element and a free second end region.

3. The garment as claimed in claim 2, wherein each attachment element substantially tapers from a relatively wide first end region to a relatively narrow second end region.

4. The garment as claimed in claim 2, wherein the second end region comprises a coupling element for coupling the respective attachment element to a lifting device.

5. The garment as claimed in claim 1, further comprising a fourth pair of flexible attachment elements each extending substantially longitudinally from a respective side of the spine element with respect to the sagittal plane of the garment and proximal an armpit region of the body portion.

6. The garment as claimed in claim 1, wherein the body portion comprises sleeve portions.

7. A system for moving an incapacitated person, comprising:

a garment according to claim 1; and a support sling comprising a pair of leg support members and a back support member, wherein each leg support member is connectable to the back support member and wherein the support sling is connectable to at least one pair of the plurality of flexible attachment elements of the garment.

8. The system as claimed in claim 7, wherein each leg support member is connectable to the back support member by a respective one of two connecting regions each comprising at least one connecting element.

9. The system as claimed in claim 8, wherein each connecting region is adapted to connect a first end region of a respective one of the leg support members to a respective end region of the back support member.

10. The system as claimed in claim 9, wherein each connecting region comprises three connecting straps extending from a common ring element to define a substantially Y-shaped connecting region.

11. The system as claimed in claim 7, further comprising a plurality of lifting straps for connecting the support sling and a fourth pair of flexible attachment elements of the flexible support portion of the garment to a hoist.

12. The system as claimed in claim 7, further comprising a fourth pair of flexible attachment elements each extending substantially longitudinally from a respective side of the spine element with respect to the sagittal plane of the garment and proximal an armpit region of the body portion.

* * * * *